US007361100B1

(12) United States Patent
Morales et al.

(10) Patent No.: US 7,361,100 B1
(45) Date of Patent: Apr. 22, 2008

(54) METAL COMPOSITE GOLF CLUB HEAD

(75) Inventors: Eric J. Morales, Phoenix, AZ (US); John C. Bliss, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 11/613,854

(22) Filed: Dec. 20, 2006

(51) Int. Cl.
*A63B 53/04* (2006.01)

(52) U.S. Cl. ..... 473/346; 473/348

(58) Field of Classification Search ..... 473/345–346, 473/348
See application file for complete search history.

(56) References Cited

U.S. PATENT DOCUMENTS

| | | | | |
|---|---|---|---|---|
| 1,616,920 | A | 2/1927 | Pedersen | |
| 3,279,048 | A | 10/1966 | Grove | |
| 4,021,047 | A | 5/1977 | Mader | |
| 4,139,196 | A | 2/1979 | Riley | |
| 4,403,653 | A | 9/1983 | Davidson | |
| 5,006,055 | A | 4/1991 | Lebisch et al. | |
| 5,198,058 | A | 3/1993 | You | |
| 5,288,070 | A | 2/1994 | Chen | |
| 5,328,176 | A | 7/1994 | Lo | |
| 5,380,328 | A | 1/1995 | Morgan | |
| 5,624,331 | A | 4/1997 | Lo et al. | |
| 5,672,405 | A | 9/1997 | Plank, Jr. et al. | |
| 5,755,826 | A | 5/1998 | Beach et al. | |
| 5,759,113 | A | 6/1998 | Lai et al. | |
| 5,814,268 | A | 9/1998 | Banchelin et al. | |
| 5,851,160 | A | 12/1998 | Rugge et al. | |
| 5,997,415 | A | 12/1999 | Wood | |
| 5,997,970 | A | 12/1999 | You | |
| 6,254,494 | B1 * | 7/2001 | Hasebe et al. | 473/349 |
| 6,471,604 | B2 | 10/2002 | Hocknell et al. | |
| 6,511,232 | B1 | 1/2003 | Ishii et al. | |
| 6,558,271 | B1 * | 5/2003 | Beach et al. | 473/327 |
| 6,575,845 | B2 | 6/2003 | Galloway et al. | |
| 6,896,006 | B2 | 5/2005 | Lindsay | |
| 7,008,332 | B2 | 3/2006 | Liou | |
| 7,037,214 | B2 * | 5/2006 | Nakahara et al. | 473/345 |
| 7,070,517 | B2 * | 7/2006 | Cackett et al. | 473/342 |
| 7,074,136 | B2 * | 7/2006 | Noguchi et al. | 473/346 |
| 7,128,662 | B2 | 10/2006 | Kumamoto | |
| 2002/0082115 | A1 | 6/2002 | Reyes et al. | |
| 2004/0147342 | A1 | 7/2004 | Lindsay | |
| 2004/0192468 | A1 | 9/2004 | Onoda et al. | |
| 2005/0161103 | A1 | 7/2005 | Lindsay | |
| 2005/0261082 | A1 * | 11/2005 | Yamamoto | 473/345 |
| 2006/0068936 | A1 * | 3/2006 | Dewhurst et al. | 473/342 |
| 2006/0079349 | A1 * | 4/2006 | Rae et al. | 473/345 |
| 2006/0151046 | A1 | 7/2006 | Lindsay | |

* cited by examiner

*Primary Examiner*—Stephen L. Blau
(74) *Attorney, Agent, or Firm*—Darrell F. Marquette; John D. Titus

(57) ABSTRACT

A golf club head is formed with a crown having an aperture with an arcuate rear edge and a forward edge that is substantially parallel to the striking face. The aperture is transected by an arcuate rib that extends from a region proximal the heel end of the crown to a region proximal the toe end of the crown and is concave toward the striking face. A pair of linear ribs extend radially outward from the arcuate rib to join the arcuate rib to a perimeter region of the crown. Openings formed in the aperture by the ribs are filled with an organic-composite material such as graphite epoxy.

13 Claims, 2 Drawing Sheets

METAL COMPOSITE GOLF CLUB HEAD

BACKGROUND OF THE INVENTION

This invention relates generally to golf clubs and, in particular, to so-called metal-wood drivers.

Recent developments in golf club design have included improvements in drivers, which are clubs used primarily to strike a golf ball resting on a golf tee. These improvements have resulted in drivers with club heads consisting of a hollow shell usually made of metal, such as steel or titanium. One example of a golf club head consisting of a hollow metal shell is disclosed in U.S. Pat. No. 5,851,160 to Rugge et al. In an effort to obtain better and better performance from these hollow metal-wood drivers, however, golf club manufacturers have increased the head volume from a moderate volume of 250 cubic centimeters as disclosed in Rugge et al. to over 400 cubic centimeters in recent years. The striking face of a metal-wood driver must be of a certain minimum thickness in order to withstand impact forces generated upon impact with a golf ball. Accordingly, as head size increases, less and less material is available for fabricating the crown, sole and skirt of the club head while maintaining the club head of these oversized drivers within acceptable weight limitations.

In U.S. Pat. No. 6,471,604, one golf club manufacturer has suggested a club head having a metallic face bonded to an aft body composed of a non-metal material such as a composite or thermoplastic material. The lightweight plastic rear body enables more metal to be dedicated to the striking face, however, many golfers dislike the impact sound produced by a club having a low resonance, highly damped non-metallic rear body. Moreover, because of the discontinuity between the all-composite or thermoplastic rear body and the striking face, the striking face is not significantly supported by the rear body. Consequently, more material must be dedicated to the striking face itself, thereby canceling out much of the weight savings attributable to the non-metallic rear body.

U.S. Pat. No. 7,008,332 to Liou suggests a metal-wood driver having large apertures in the crown and skirt. The apertures are then covered by a graphite cover that conforms to the crown and skirt portions of the club head. The large aperture in the crown and/or skirt enable more metal to be dedicated to the striking face. Because of the large apertures, however, the striking face is not significantly supported by the crown and/or sole. Therefore, more material must be dedicated to the striking face itself, which cancels out much of the weight savings attributable to the large apertures. Implicitly recognizing the disadvantages of a club head in which the face is unsupported by the crown, the '332 patent discloses one embodiment in which the face is supported by a single rib perpendicular to the face, bisecting the crown aperture. A single perpendicular rib, however, itself produces a stress concentration at the point where it merges with the crown extension behind the face. Moreover, a single rib is easily driven into a first bending mode vibration upon impact of the face with a golf ball. Thus the single perpendicular rib not only provides little support for the face but also dissipates impact energy by its vibrational oscillations, thereby leaving less energy available to be imparted to the golf ball.

Accordingly, what is needed is a club head having crown apertures that are strategically located in areas that are not excited by the crown bending moments induced by ball impact and therefore permit relocation of material from the crown to other areas of the club head without reducing the stiffness of the crown or lowering its natural frequencies.

SUMMARY OF THE INVENTION

The present invention comprises a golf club head formed of a body having a metallic face and a crown having an aperture formed therein. According to an illustrative embodiment of the invention, the aperture having an arcuate rear edge and a forward edge that is substantially parallel to the club head face. The aperture is transected by an arcuate rib that extends from a region proximal a heel end of the crown to a region proximal a toe end of the crown. A pair of linear ribs extend radially outward from the arcuate rib to join the arcuate rib to a perimeter region of the body. A plurality of openings formed in the aperture by the ribs are filled with an organic-composite material such as graphite epoxy. Because the graphite epoxy is lighter than the surrounding metal, the crown is lighter than in a comparable all-metal club head. Yet, the presence of the metallic ribs renders the metal-composite crown substantially stiffer than either a comparable all-composite crown or a crown structure supported by a single perpendicular rib.

DESCRIPTION OF THE INVENTION

Figure 1:
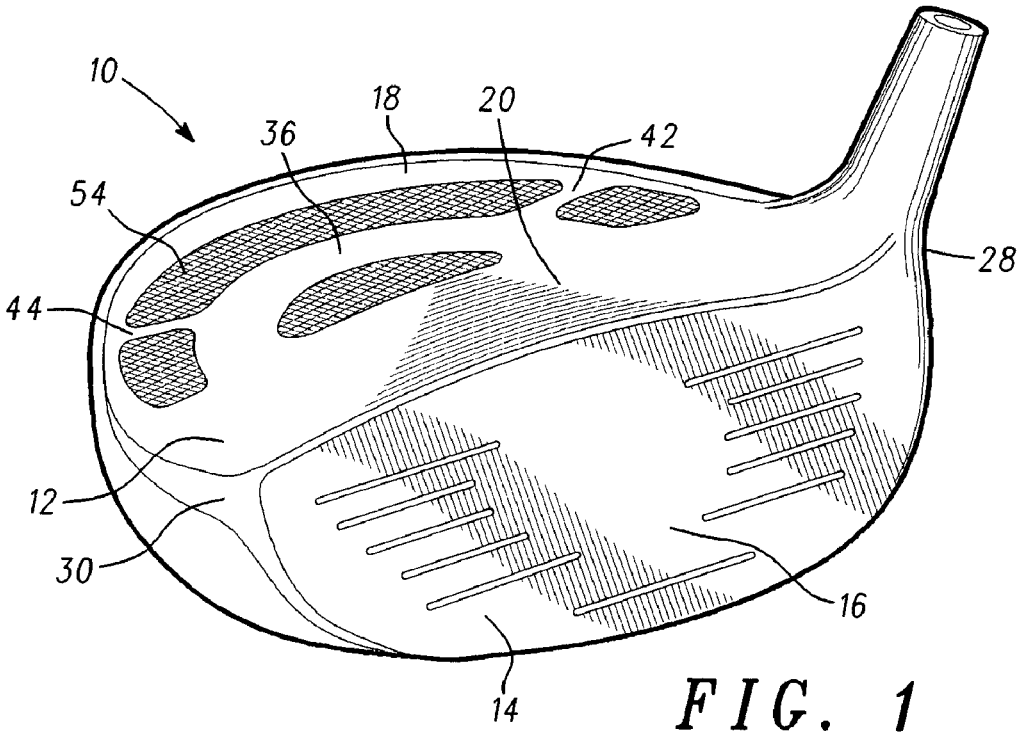
FIG. 1 is a front perspective view of a golf club head incorporating features of the present invention.
Figure 2:
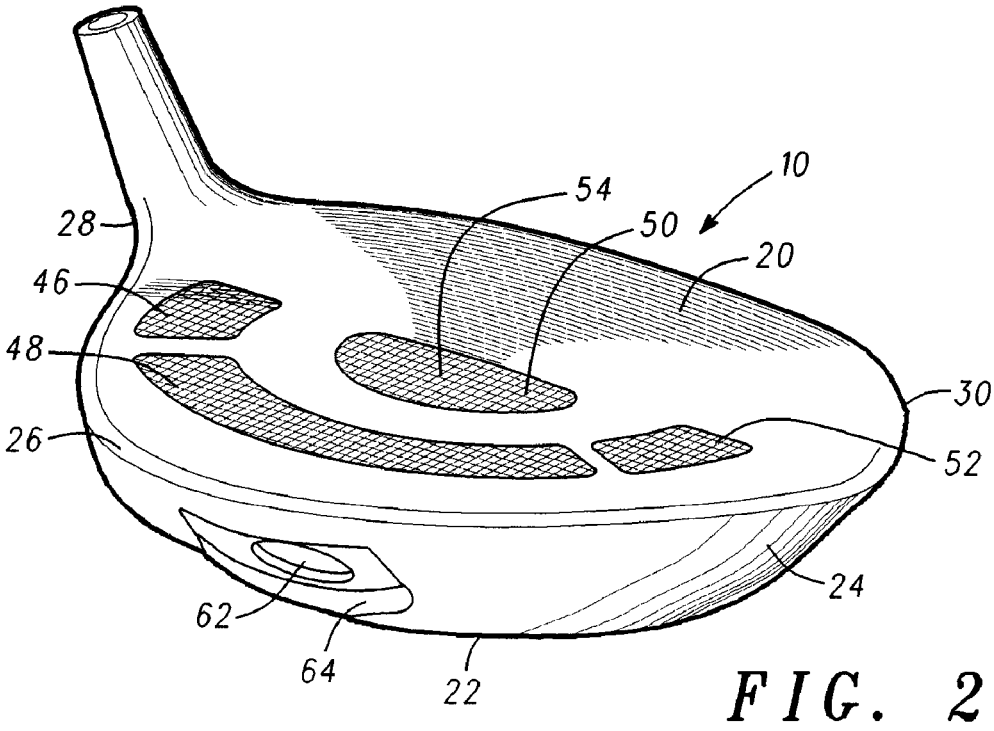
FIG. 2 is a rear perspective view of the golf club head of FIG. 1.
Figure 3:
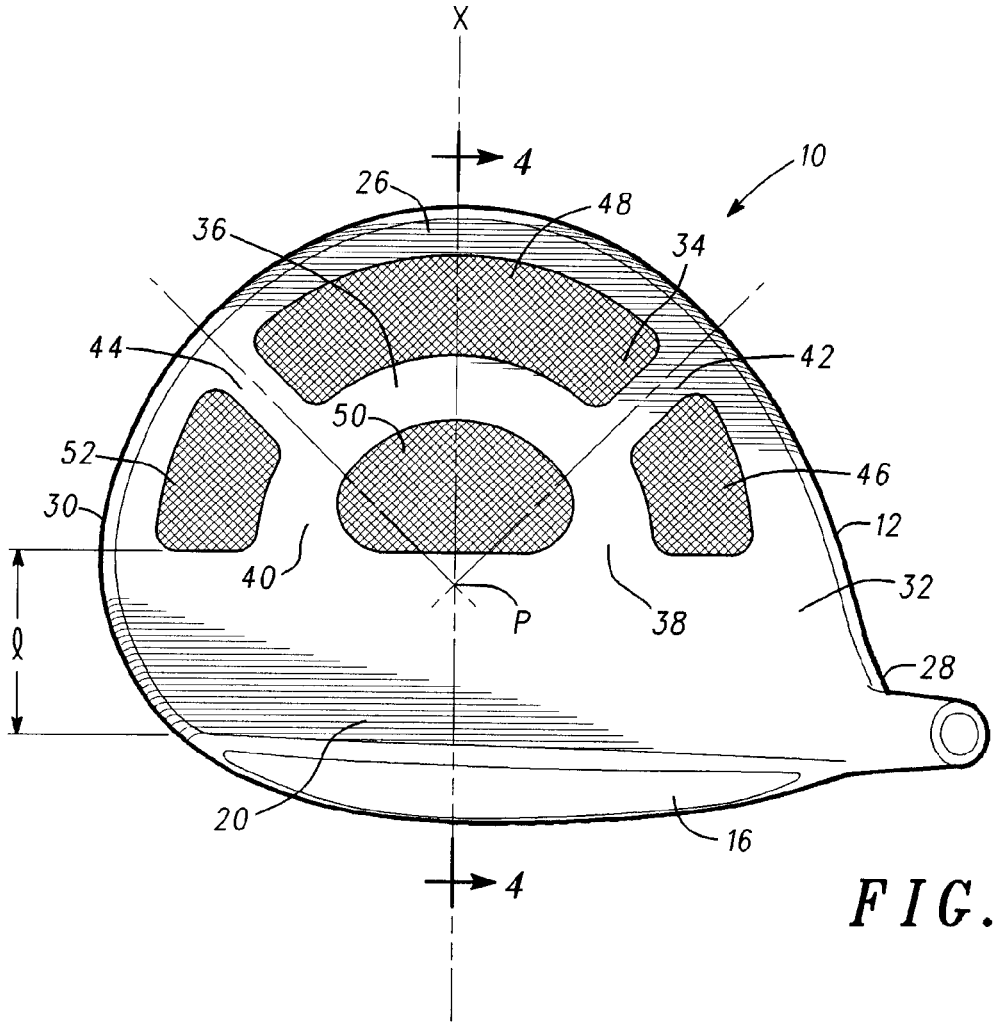
FIG. 3 is a top view of a golf club head of FIG. 1.
Figure 4:
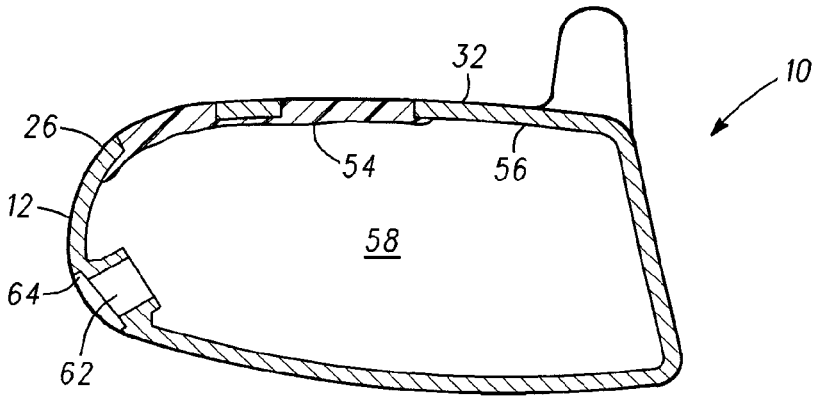
FIG. 4 is a cross-sectional view of the club head of FIG. 3 taken along line 4-4.

With reference to FIGS. 1-4, golf club head 10 comprises a body 12 formed of a metal material having a front wall 14 including a face 16 for impacting a golf ball. Body 12 further comprises a rear body portion 18 comprising a crown 20, a sole 22 and a skirt 24 that form a hollow shell. Crown 20 and skirts 24 meet at a perimeter region 26 which comprises an area having a small cross-sectional radius of curvature and which extends in a continuous arcuate path from a heel end 28 of body 12 to a toe end 30 of body 12. Body 12 may be assembled from a series of forged metal pieces that are welded or braised together, but in the illustrative embodiment comprises a titanium investment casting. Crown 20 is formed with a solid rear extension region 32 that extends rearward from face 16 for 20-60 millimeters, preferably for 25-45 millimeters and most preferably for about 30 millimeters rearward from face 16 as indicated by dimension l in FIG. 3. Crown 20 further includes an aperture 34 formed therein rearward of rear extension region 32. Aperture 34 is transected by an arcuate rib 36, which extends from a first end 38 proximal body heel end 28 to a second end 40 proximal body toe end 30.

Aperture 34 is further transected by linear ribs 42 and 44 which extend from arcuate rib 36 and join it to perimeter region 26. As can be seen from an inspection of FIG. 3, ribs 42 and 44 are symmetrically disposed about an axis "X" that extends perpendicular to the face 16 through the mid-point of arcuate rib 36. Linear ribs 42 and 44 also project substantially radially from a point "P" that is located on axis "X."

Arcuate rib 36 and linear ribs 42 and 44 cooperate to divide aperture 34 into four openings 46, 48, 50 and 52.

Openings 46, 48 and 52 are in the form of annular sectors while opening 50 is in the form of a circular segment. Openings 46, 48, 50 and 52 are disposed in a symmetrical pattern about axis "X" which passes through the center of aperture 50. In a preferred embodiment, axis "X" passes through the intended ball impact zone such that the ball impact forces are distributed evenly across the pattern of ribs 36, 42, 44 and openings 46, 48, 50, 52 so as to maximize the efficiency of the crown 20.

Openings 46, 48, 50 and 52 are filled with a material that is of lower density than the denser metallic material forming the body 12. The low density material may be a lightweight nonmetallic material 54 such as thermoplastic, thermosetplastic, or preferably a fiber reinforced organic resin such as fiberglass-epoxy, fiberglass-polyester, ceramic-fiber epoxy, aramid-epoxy or other fiber-organic resin composites. Preferably, the nonmetallic material 54 comprises graphite-epoxy, which is laid up on the inside surface 56 of body 12 extending from rear extension region 32 to perimeter region 26 to form a part titanium, part carbon-graphite composite rear body portion 18. The nonmetallic material 54 extends across and closes the aperture 34.

In the illustrative embodiment, non-metallic material 54 comprises prepreg layers of graphite epoxy, which are laid up on the inside surface 56 of body 12 extending across and closing openings 46, 48, 50 and 52. An inflatable bladder (not shown) is then inserted into the cavity 58 of body 12 through aperture 62 disposed in the bottom of a weight pocket 64. Body 12 is then placed in a mold cavity (not shown) that conforms to the outside surface of the body 12. The bladder is then inflated and the mold heated to cure the prepreg epoxy.

By eliminating metal from portions of crown 20 as represented by openings 46, 48, 50 and 52, the illustrative embodiment yields a club head 10 in excess of 400 cubic centimeters in volume with the body 12 weighing in the region of 150 grams and the composite filler weighing approximately 40 grams. The face 16, therefore, can be increased to at least 5.00 square inches (preferably approximately 5.3 square inches) with a maximum thickness of between 0.110 and 0.160 inches. This is accomplished without sacrificing structural integrity and without exceeding the desired total weight of about 200 grams mass. The unique configuration of a crown aperture 34 with an arcuate rib 36 that corresponds to the crown high stress region during ball impact yields an unprecedently efficient, lightweight structure for supporting the face while also maintaining the desirable dominant natural frequency of at least 3,500 hertz.

What is claimed is:

1. A golf club head comprising:

a body formed of a metallic material, said body having an inside surface, an outside surface, a heel end, a toe end, a front wall and a rear body portion, said front wall including a face adapted for impacting a golf ball, said rear body portion including a crown, a sole, and a perimeter region extending continuously from said toe end to said heel end, said body further comprising a solid rear extension comprising a solid wall extending at least 20 millimeters rearward from a crown region of said front wall and first and second openings formed in the crown, said first and second openings each being in the form of an annular sector rearward of said solid rear extension;

a nonmetallic material extending across and closing said first and second openings;

said first and second openings are concave toward the front wall of said body and convex toward the rear body portion of said body;

said body comprising a third opening formed in the crown;

said third opening having the form of an annular sector that is concave toward the front wall of said body and convex toward the rear body portion of said body;

said nonmetallic material extending across and closing said third opening;

said body comprising a fourth opening formed in the crown;

said fourth opening being substantially semi-circular in shape; and said nonmetallic material extending across and closing said fourth opening.

2. The golf club head of claim 1, further comprising:

a first rib extending between said third and fourth openings from a first end attached to said solid rear extension proximal the toe end of said body to a second end attached to said solid rear extension proximal the heel end of said body; and a second rib extending between said first and third openings from a medial region of said first rib to said perimeter region.

3. The golf club head of claim 2, wherein said first rib has an arcuate shape and is concave toward the front wall of said body and convex toward the rear body portion of said body.

4. The golf club head of claim 2, further comprising:

a third rib extending between said second and third openings from a medial region of said first rib to said perimeter region.

5. The golf club head of claim 4, wherein said second and third ribs extend substantially radially from a point on a line extending perpendicular to the face intermediate the first and second ends of said first rib.

6. The golf club head of claim 4, wherein said second rib extends toward the heel end of said body and said third rib extends toward the toe end of said body.

7. The golf club head of claim 4, wherein said second and third ribs are disposed substantially symmetrically about an axis extending perpendicular to said face through the geometric center of said crown.

8. The golf club head of claim 1, wherein said first opening is symmetric about a plane perpendicular to the face.

9. The golf club head of claim 1, wherein said first, second and third openings form a pattern that is symmetric about a plane perpendicular to the face.

10. The golf club head of claim 1, wherein said nonmetallic material is bonded to said body.

11. The golf club head of claim 1, wherein said nonmetallic material is bonded to the inside surface of said body.

12. The golf club head of claim 1, wherein said rear body portion includes a skirt, and wherein said perimeter region forms a junction between said crown and said skirt.

13. The golf club head of claim 1, wherein:

said solid rear extension extends between 20 and 60 millimeters rearward from the crown region of said front wall.

* * * * *